US006847017B2

(12) United States Patent
Starck et al.

(10) Patent No.: US 6,847,017 B2
(45) Date of Patent: Jan. 25, 2005

(54) ELECTRIC HEATING ARRANGEMENT

(76) Inventors: Roland Starck, Im Vogelgesang 29, 76870 Kandel (DE); Franz Flick, Essinger Strasse 86, 76877 Offenbach (DE); Frank Kamy, Bahnhofstrasse 48a, 76751 Jockgrim (DE)

( * ) Notice: Subject to any disclaimer, the term of this patent is extended or adjusted under 35 U.S.C. 154(b) by 0 days.

(21) Appl. No.: 10/691,322

(22) Filed: Oct. 22, 2003

(65) Prior Publication Data

US 2004/0104215 A1 Jun. 3, 2004

(30) Foreign Application Priority Data

Oct. 22, 2002 (DE) ..... 202 16 509 U

(51) Int. Cl.[7] ..... H05B 3/40

(52) U.S. Cl. ..... 219/534; 219/530; 219/540; 219/544; 338/221

(58) Field of Search ..... 219/534, 544, 219/530, 540, 505, 546, 548; 338/221

(56) References Cited

U.S. PATENT DOCUMENTS 3,996,447 A 12/1976 Bouffard et al.
4,147,927 A * 4/1979 Pirotte ..... 219/541
4,228,343 A 10/1980 Kanner et al.
4,468,555 A 8/1984 Adachi et al.
4,763,102 A * 8/1988 Ritt ..... 338/240
4,822,980 A 4/1989 Carbone et al.
6,180,930 B1 1/2001 Wu

FOREIGN PATENT DOCUMENTS

DE 2614433 10/1976
DE 3616460 11/1987
DE 4040258 7/1992

OTHER PUBLICATIONS

Heat Exchanger Design by Arthur P. Fraas and M. Necati Ozisik, 1965, John Wiley and Sons, Inc. p. No. 33, 347, 352.*

* cited by examiner

*Primary Examiner*—Robin O. Evans
*Assistant Examiner*—Vinod Patel

(57) ABSTRACT

The electric heating arrangement (1) has a tubular housing (2) in which is provided at least one PTC heating element (20) and at least one pair of metallic heat dissipators (9) between which the at least one heating element (20) is clamped and which for this purpose each comprise a base portion (10) facing the at least one heating element and one or two curved legs (15) projecting from said base portion, which adapt themselves resiliently to the inner surface of the surrounding wall of the housing (2). The invention provides that the legs (15) taper toward their free ends and/or that the base portion (10) is thicker than the legs (15) projecting it.

20 Claims, 4 Drawing Sheets

ELECTRIC HEATING ARRANGEMENT

BACKGROUND OF THE INVENTION

The present invention relates to an electric heating arrangement having the features defined in the preamble of Claim 1. A heating arrangement of that kind is known from DE 26 14 433 C3. The known heating arrangement comprises a tubular housing in which a PTC heating element is arranged between two metallic heat dissipators. The heat dissipators comprise a flat base facing the PTC heating element, with curved legs projecting from its longitudinal edge that are in resilient contact with the inner wall of the housing. The heat produced by the PTC heating element is thus absorbed by the heat dissipators through their bases and is transferred to the housing via their legs. It is a disadvantage of such known heating elements that they are suited only for low heat output, for example of 14 W, and that thermal coupling of the PTC heating element to the housing will progressively degrade over time, especially in cases of higher output. Especially when liquids are to be heated in a motor vehicle, for example urea solutions which are required for catalytic converters, the known heating arrangement is not suited because of its low output and because of the relatively rapid degradation of the thermal coupling efficiency between the PTC heating element and the housing.

SUMMARY OF THE INVENTION

Now, it is the object of the present invention to open up a way of achieving permanently improved thermal coupling of the PTC heating element to the housing in a heating arrangement of the before-mentioned kind even over an extended period of time and with higher power output in the range of several 100 Watts, as required in passenger car applications.

This object is achieved by an electric heating arrangement having the features defined in Claim 1 or defined in claim 3. Advantageous further developments of the invention are the subject-matter of the sub-claims.

In the case of the heating arrangement according to the invention as shown in FIG. 1 the leg/legs of the heat dissipators taper toward their free ends. Basically, a single leg projecting from the base portion of the respective heat dissipator would be sufficient. Preferably, however, two legs project from the base portion. In both cases the aim is that the legs should transfer the heat generated by the heating arrangement to the medium to be heated as efficiently as possible.

According to a particularly preferred solution, the legs taper continuously and uniformly over their full length. Surprisingly it has been found that using this simple measure one achieves considerably improved and more uniform thermal coupling between the PTC heating element and the housing. The temperature differences between the different areas of the housing, and between the housing and the heat dissipators, are lower than in arrangements of the prior art which has the further advantageous effect to reduce the differences in locally occurring thermal expansion between the respective materials. Now, the smaller the differences in thermal expansion between the different parts of the heating element, the more reliable and durable can the legs of the heat dissipators adapt themselves to the inner wall of the housing, thereby ensuring optimum thermal coupling between the PTC heating element and the housing. In addition, uniform heat distribution and uniform surface temperature of the housing guarantee optimum heat transfer.

It is advantageous for this purpose if the leg, or the legs together, cover the inner surface of the surrounding wall of the housing as fully as possible, preferably nearly completely. Preferably, those ends of the legs, which are attached to the base portion of the respective heat dissipator, have the greater thickness. This feature provides the advantage to provide high mechanical stability of the heat dissipator with the result that the legs can be pressed against the housing at higher force, especially if the base portion is robust, too. Preferably, the base portion is thicker than the legs projecting from it so that it can be regarded as being rigid, compared with the legs. This advantageously leads to even better heat transfer from the PTC heating element to the housing because intimate contact is ensured between both the heat dissipator and the heating element and between the heat dissipator and the housing.

According to FIG. 3, the object of the invention is achieved by the fact that the base portion of the heat dissipators is thicker than the legs projecting from it, which are to adapt themselves resiliently to the housing. This provides the advantage that the base portion exhibits higher rigidity than the legs and can prevent the base portion from bending and from partially losing contact to the heating element when the legs are bent. Instead, the heat transfer from the heating element to the heat dissipator remains guaranteed.

The teaching of Claim 1 can be combined very advantageously with the teaching of Claim 3.

An advantageous further development of the invention provides that the base portion is made especially thick on its side facing away from the heating element, in the middle between the legs. One thereby achieves especially high stability of the heat dissipators and high thermal conductivity. The legs can be subjected to greater pre-stress without any bending risk for the base. The greater the pre-stress acting on the leg, the higher will be the force at which it will be pressed against the inner surface of the housing and, accordingly, thermal coupling to the housing. If the base portion is made thicker in its central portion than at its ends from where the leg or the legs project, this moreover enhances the flexibility of the legs and increases the length over which they can bend easily.

It is preferred that the base portion comprises on its side facing away from the heating element a U-shaped receiving portion extending in the longitudinal direction of the housing. Advantageously, an electric connection line for the PTC heating element may be inserted into such a U-shaped receiving portion, and may be fixed by soldering or welding and/or pressing, so that an electric connection can be realised without any separate connection elements.

Another advantageous further development of the invention provides that the housing is deformed by the legs of the heat dissipators pressing against its inner surface. A tubular housing, for example, having a circular cross-section before the heating arrangement is assembled, may be deformed in this way to assume an elliptical or oval cross-section. Such deformability of the housing enhances the full-surface intimate application of the legs against the heat dissipators. Especially, it is then possible, if the housing and the one or more heat dissipators consist of different materials and, consequently, have different thermal expansion coefficients, to achieve good surface contact between the legs and the housing and to ensure good thermal coupling over a wide temperature range. Preferably, the wall thickness is, therefore, smaller than the thickness of the legs, being preferably in the range of between 0.1 mm and 0.7 mm only, most preferably in the range of between 0.2 mm and 0.5 mm. It has been found that if such wall thicknesses are used, the housing will on the one hand still reliably protect the interior of the heating arrangement, while on the other hand it will be deformed a little by the legs of the heat dissipators pressing against its inner surface so that good surface contact is achieved between the housing and the legs.

A heating arrangement according to the invention may of course be equipped with a single PTC heating element or with a plurality of PTC heating elements. Similarly, the heat dissipator may extend over the full length of the housing equipped with PTC elements, or there may be provided a plurality of heating elements arranged one behind the other in the tubular housing. A particularly advantageous arrangement is achieved if the at least one PTC heating element is arranged between pairs of heat dissipators the bases of which are arranged one opposite the other. One thereby achieves especially efficient heat dissipation from both surfaces of the PTC heating element.

Another advantageous further development of the invention provides that the heat dissipators consist of aluminium or of an aluminium alloy. Aluminium and aluminium alloys distinguish themselves by high thermal conductivity. In addition, aluminium and aluminium alloys allow low-cost production of the heat dissipators by press-drawing. Especially preferred for this purpose are AlMgSi alloys, for example AlMgSi1F32 alloys, which combine in themselves good resilience with good thermal conductivity. Another advantageous further development of the invention provides that the housing has an open end with an integral flange formed thereon. The flange provided on the open end of the housing facilitates introduction of the heating insert, containing the one or more heating elements and the heat dissipators, into the housing. Once the inner elements have been introduced into the housing, its upper open side can then be closed tightly. This preferably is effected using a plastic cap, preferably with a sealing ring arranged between the flange and the plastic cap. Following this process, the upper open side is tightly sealed using a casting compound, for example a silicone plastic compound, the necessary electric connections being run to the outside through the sealing compound. Another advantageous further development of the invention provides that the housing is made from stainless steel. This feature provides the advantage that the housing will not be attacked by corrosive liquids, for example by a urea solution as used in catalytic converters of motor vehicles. Alternatively, it is however also possible to make the housing from aluminium, which may be anodised and/or provided with a corrosion-resistant coating, for applications in corrosive liquids. There is, however, also the possibility to make the housing from a plastic material exhibiting relatively high thermal conductivity, compared with other plastic materials, for example a PTFE filled with mineral or ceramic fillers.

BRIEF DESCRIPTION OF THE DRAWING FIGURES

Further details and advantages of the invention will be discussed hereafter with reference to one embodiment of the invention and the attached drawings in which.

Figure 1:
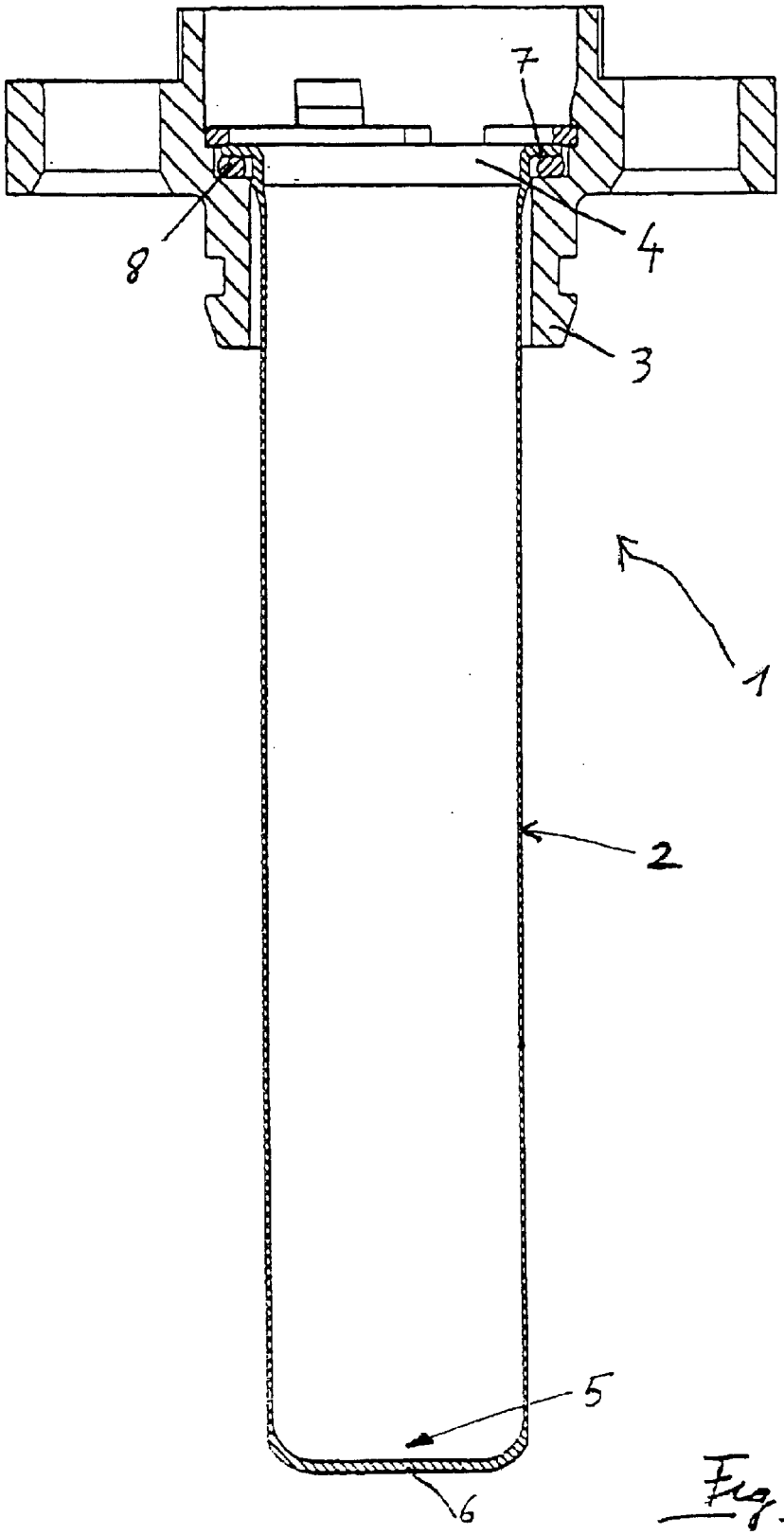
FIG. 1 shows a longitudinal section through the housing of one embodiment.

FIG. 1 shows a longitudinal section of the cylindrical housing 2 of a heating arrangement 1, the upper open end 4 of which is provided with a plastic cap 3. The opposite lower end 5 of the housing 2 is closed. In the illustrated embodiment, the housing 2 has been produced from stainless steel as a single-piece by deep-drawing a tubular member from sheet metal followed by inserting a mandrel into the tubular member and rolling it whereby the tubular member is stretched further. However, producing the housing 2 from a tubular semi-finished product and attaching a bottom 6 subsequently by welding, soldering, beading, pressing, or the like, would also be possible. Formed integrally with the upper open end 4 of the housing is a flange 7. The flange 7 on the one hand provides the advantage to serve as a guide when the inner elements are inserted—see FIG. 2—while on the other hand it facilitates the attachment of a plastic cap 3 via an interposed sealing ring 8, if desired.

Figure 2:
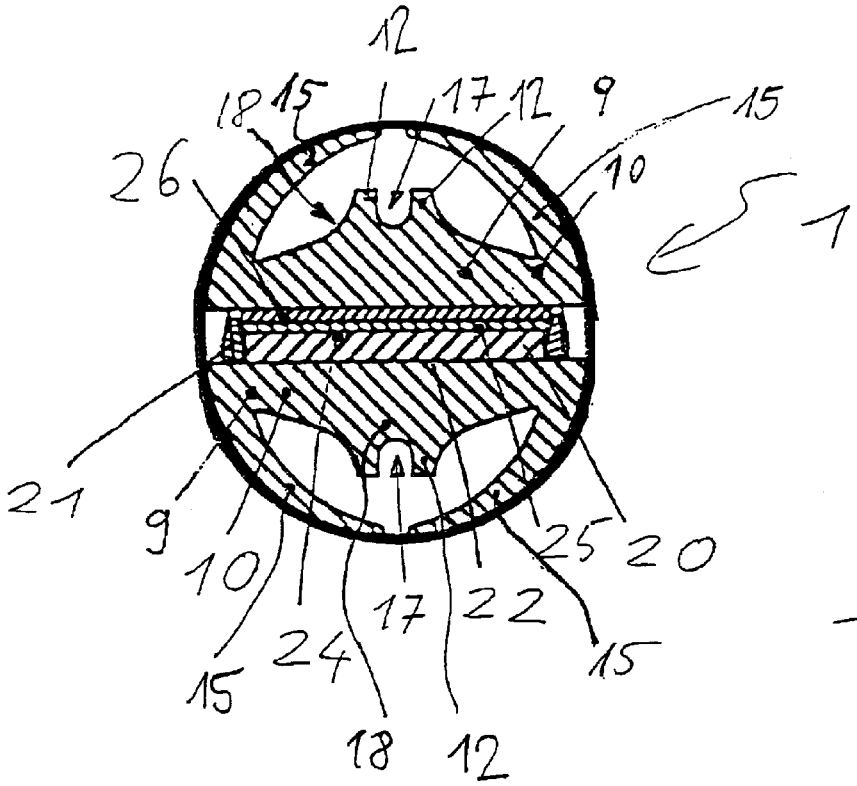
FIG. 2 shows a cross-section through that embodiment.

FIG. 2 shows a cross-section of the heating arrangement 1 after the inner elements have been inserted. The heat produced by the PTC heating elements 20 is transferred to the housing 2 via heat dissipators 9 which include between them the PTC heating element 20. The heat dissipators 9 have a base portion 10 the flat side of which faces the PTC heating element 20 and is in good thermally conductive contact with the PTC heating element 20. From the base portion 10 of the metallic heat dissipator 9, the heat is carried off via curved legs 15 that project from the base portion 10 and press resiliently against the inner surface of the housing 2. In order to achieve optimum thermal coupling between the housing 2 and the legs 15 of the heat dissipators 9 it is important that the latter always press against the housing 2 at the highest possible spring power. High temperature gradients and, thus, locally different thermal expansion counteract, however, such uniform pressing effect. To overcome this situtation, the legs 15 are designed to taper uniformly over their full length toward their ends. This feature counteracts the development of a temperature gradient along the legs 15 and improves, through uniform contact pressure, the thermal coupling effect between the heat dissipator 9 and the housing 2.

DETAILED DESCRIPTION OF THE PREFERRED EMBODIMENTS

The following is a more detailed description of the structure of the heating arrangement 1:

One or more flat PTC heating elements 20 have been inserted into a frame 21, made from plastic, and have been secured in such frame against displacement. The bottom contact surfaces 22 of the PTC heating elements 20 are in direct contact with the flat side of the base 10 of a first heat dissipator 9. The upper contact surfaces 24 are completely covered by a contact plate 25. Formed integrally on the contact plate 25 is a connection element (not shown) serving as current supply, which is run to the outside from the heating arrangement 1. The contact plate 25 in turn is covered by an insulating layer 26, preferably made from a ceramic material. The insulating layer 26 is selected to be as thin as possible. The flat side of the base element 10 of a second heat dissipator 9 is placed on that insulating layer 26.

Figure 3:
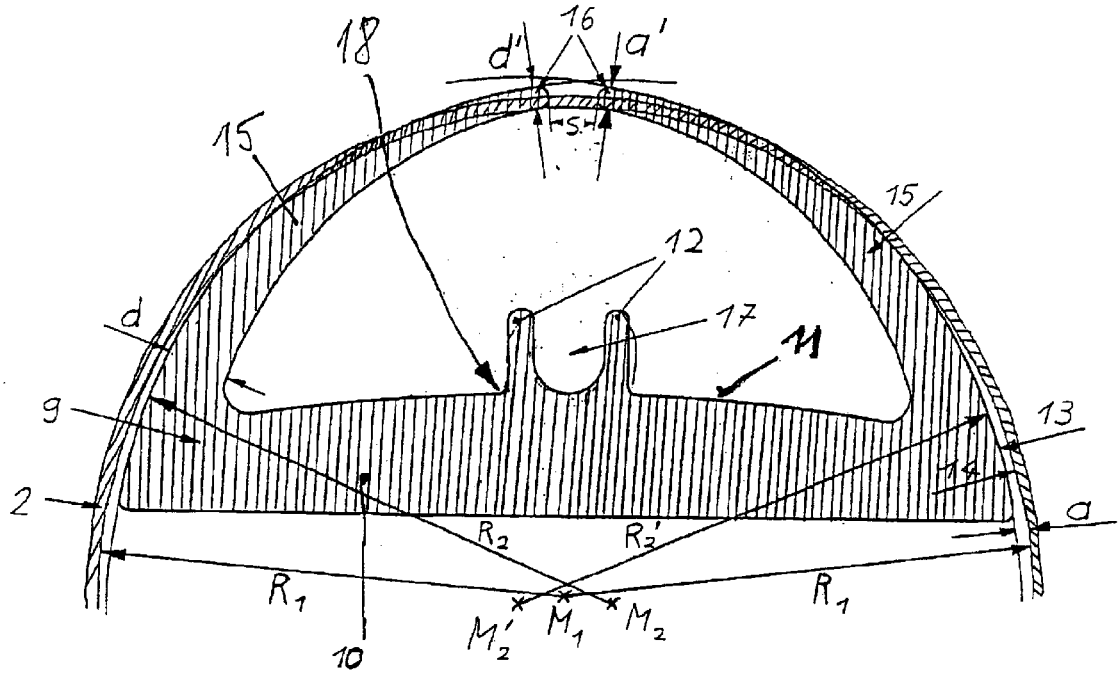
FIG. 3 shows a heat dissipator and a detail of the housing.

The two heat dissipators 9 preferably exhibit the same design. While current is supplied, as has been described above, via a connection element provided on the contact plate 25, the ground connection is formed in the U-shaped receiving portion 17 in the base 10 of the heat dissipator 9 (not shown) by a connection wire that has been pressed into the receiving portion 17 and has been run out of the heating arrangement 1. A thicker portion 18 of the base 10 improves the mechanical stability of the heat dissipators 9 and allows higher pressing forces to be applied on the housing 5 by the legs 15, without causing the base 10 to bend and to be partially lifted off the heating element 20. As shown in FIG. 3, the thicker portion 18 may terminate in extensions 12 forming the U-shaped receiving portion 17 for a ground wire. The receiving portion 17 is not actually needed for the second heat dissipator 9 if the housing 2 is connected to ground. For production reasons it is, however, most favourable if both heat dissipators 9 have the same configuration.

In the case of an insulating housing 2 with a thin insulating layer between the metallic surrounding wall of the housing 2 and the heat dissipators 9 it would, however, likewise be possible to fix a wire as potential connection at this point.

Figure 4:
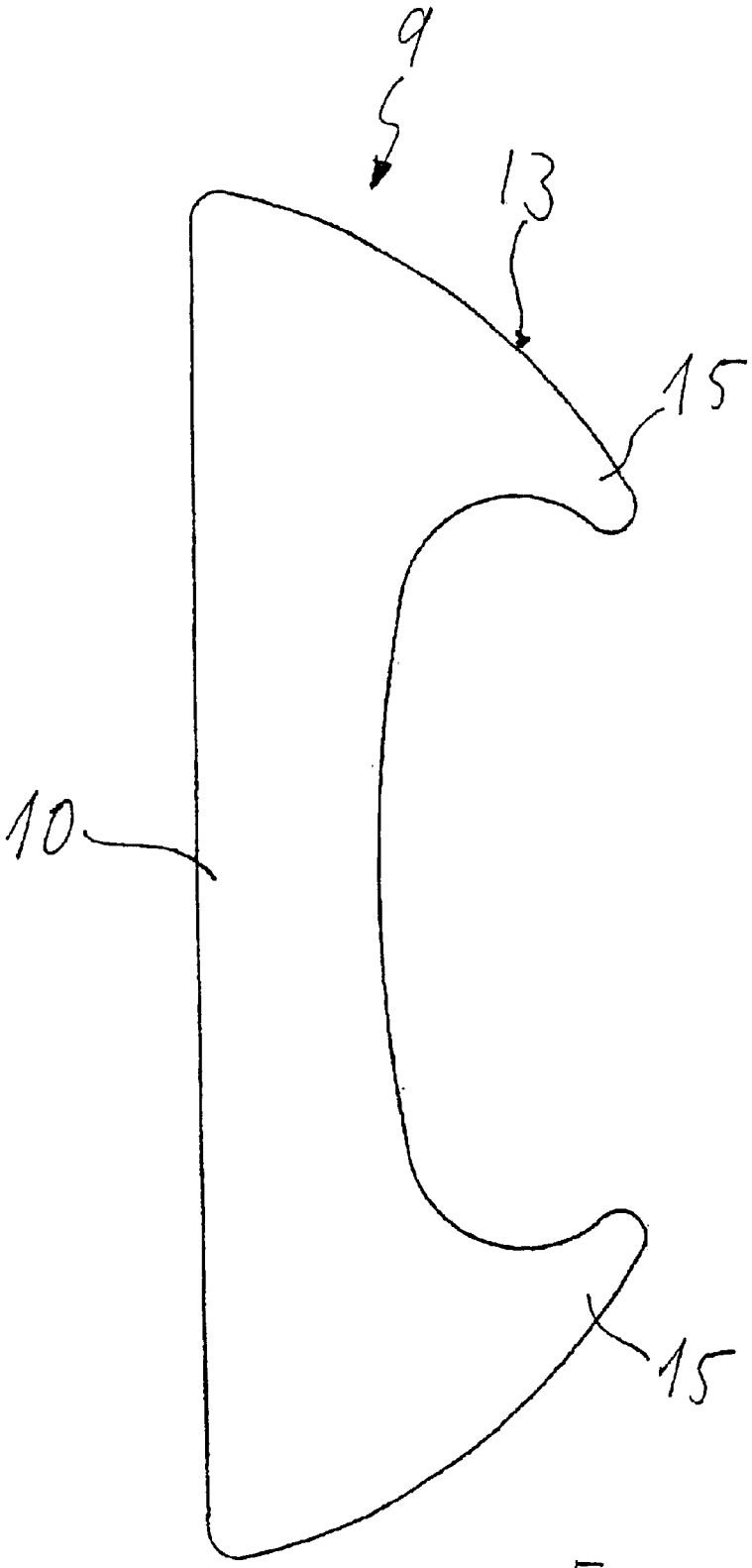
FIG. 4 shows an alternative embodiment of a heat dissipator.

In a variant of an insulating housing 2 where a contact plate and an insulating layer are inserted on both sides between the PTC heating element 20 and the heat dissipator 9, the receiving portion 17 is, however, not needed for fixing the connection wire because in this case both the ground connection and the potential connection are established via contact plates. One embodiment of such a heat dissipator is illustrated in FIG. 4.

The spring power of the legs 15 of the heat dissipators 9 leads to a slightly oval elastic deformation of the housing 2 with the contours of the inner surface 14 of the housing and of the outer surfaces 13 of the legs being in optimum full-surface pressing contact with each other, thereby forming the largest possible heat transfer surface. In order to achieve a slight deformation of the housing 2 by the legs 15 pressing against it—which, as mentioned before, leads to improved thermal coupling—the housing 2 has a wall thickness of 0.4 mm only while the heat dissipators 9 are considerably thicker. A material particularly well suited for the housing 2 is stainless steel because this material can be used in many corrosive liquids, for example in a urea solution.

FIG. 3 shows a single heat dissipator 9 and part of the housing 2 prior to assembly. As can be seen, the radius R2 and R2 ' of the outer surfaces 13 of the legs is a little greater than the radius R1 of the inner surface of the originally cylindrical housing 2. The centre point M1 is located centrally in the middle of the housing 2. R2 and R2' have no common centre point, M2 as centre point of R2 and M2 ' as centre point of R2 ' being defined a little laterally of M1 and below the centre line of the housing 2. This leads to a positive distance a between the outer surface of the legs 13 and the inner surface of the housing 2 at the underside of the base 10 of the heat dissipator 9 and to a negative distance a' at the tips 16 of the legs 15 in the pre-assembly condition.

The pressure exerted by the spring power after assembly causes the outer surfaces 13 of the legs and the inner surface 14 of the housing to apply themselves so snugly one against the other that the distances a and a' tend substantially towards zero so that the outer surfaces of the legs and the inner surface of the housing are in surface-to-surface contact and, thus, in thermally conductive contact one with the other. In order to prevent the base 10 of the heat dissipator 9 from buckling under the effect of the spring power, and yet to guarantee sufficient elasticity of the legs 15, the base 10 is given an especially great thickness. This simultaneously makes it particularly well suited for heat conduction.

The legs 15 have a thickness d in their starting regions and taper toward their tips 16 to assume a thickness d'. This guarantees efficient heat conduction along the legs 15 and simultaneously high elasticity of the tips 16. Prior to assembly, a small distance s exists between the tips 16, which is further reduced as the tips are pressed one against the other during assembly. The distance s is selected to be as small as possible with a view to achieving a large heat transfer surface without any gaps and, on the other hand, to providing sufficient play for easy installation and compensation of thermal expansion effects. The described heat dissipator 9 with its profiled cross-section is preferably cut from an extruded profile material produced from an aluminium alloy.

What is claimed is:

1. Electric heating arrangement having a tubular housing in which is provided at least one PTC heating element and at least one pair of metallic heat dissipators between which the at least one heating element is clamped and which for this purpose each comprise a base portion facing the at least one heating element and one or two curved legs projecting from said base portion, which adapt themselves resiliently to the inner surface of the surrounding wall of the housing, wherein the legs taper toward their free ends.

2. The heating arrangement as defined in claim 1, wherein the base portion is thicker than the legs projecting from it.

3. Electric heating arrangement having a tubular housing in which is provided at least one PTC heating element and at least one pair of metallic heat dissipators between which the at least one heating element is clamped and which for this purpose each comprise a base portion facing the at least one heating element and one or two curved legs projecting from said base portion, which adapt themselves resiliently to the inner surface of the surrounding wall of the housing, wherein the base portion is thicker than the legs projecting from it.

4. The heating arrangement as defined in claim 3, wherein the legs taper toward their free ends.

5. The heating arrangement as defined in claim 1 or 3, wherein the legs taper continuously over their full length.

6. The heating arrangement as defined in claim 5, wherein the legs taper uniformly.

7. The heating arrangement as defined in claim 1 or 3, wherein the base portion has the greatest thickness in the middle between the legs projecting from it.

8. The heating arrangement as defined in claim 1 or 3, wherein two extensions extending in the longitudinal direction of the housing are formed on the base portion, on its side facing away from the heating element, which extensions form a terminal of U-shaped cross-section for a power supply cable.

9. The heating arrangement as defined in claim 1 or 3, wherein the base portion exhibits a flat, especially a plane, configuration on its side facing the PTC heating element.

10. The heating arrangement as defined in claim 1 or 3, wherein the surrounding wall of the housing is thinner than the base portion and the legs.

11. The heating arrangement as defined in claim 1 or 3, wherein the wall thickness of the housing is 0.1 mm to 0.7 mm.

12. The heating arrangement as defined in claim 1 or 3, wherein the heat dissipators consist of aluminium or an aluminium alloy.

13. The heating arrangement as defined in claim 12, wherein the heat dissipators are made from an extruded profile material.

14. The heating arrangement as defined in claim 1 or 3, wherein for mounting the heating elements the housing comprises an open end with an integrally formed flange which can then be closed after assembly.

15. The heating arrangement as defined in claim 14, wherein a plastic cap is held on the flange of the housing.

16. The heating arrangement as defined in claim 15, wherein a sealing ring is arranged between the plastic cap and the flange.

17. The heating arrangement as defined in claim 1 or 3, wherein the housing consists of stainless steel.

18. The heating arrangement as defined in claim 1 or 3, wherein the legs together cover almost the whole inner surface of the surrounding wall of the housing.

19. The heating arrangement as defined in claim 1 or 3, wherein the wall thickness of the housing is 0.2 mm to 0.5 mm.

20. The heating arrangement as defined in claim 1 or 3, wherein the housing is deformed by the legs of the heat dissipators applying themselves resiliently against its surrounding wall.

* * * * *